United States Patent [19]

Rothenberger

[11] 4,355,528

[45] Oct. 26, 1982

[54] DEVICE FOR BENDING METAL PIPE

[75] Inventor: Günter Rothenberger, Bad Homburg, Fed. Rep. of Germany

[73] Assignee: Rothenberger GmbH & Co., Frankfurt am Main, Fed. Rep. of Germany

[21] Appl. No.: 123,324

[22] Filed: Feb. 21, 1980

[30] Foreign Application Priority Data

Feb. 9, 1979 [DE] Fed. Rep. of Germany ..... 2904885

[51] Int. Cl.[3] ..... B21D 7/02

[52] U.S. Cl. ..... 72/388; 72/217; 72/459

[58] Field of Search ..... 72/388, 387, 217, 218, 72/149, 206, 459

[56] References Cited

U.S. PATENT DOCUMENTS

| | | | |
|---|---|---|---|
| 2,464,800 | 3/1949 | Franck | 72/388 |
| 2,654,279 | 10/1953 | Tomarin | 72/388 |
| 2,757,562 | 8/1956 | Zales | 72/388 |
| 2,820,504 | 1/1958 | Henderson | 72/406 |
| 3,380,283 | 4/1968 | Wilson | 72/387 |
| 3,410,125 | 2/1967 | Schmidt | 72/156 |
| 4,132,100 | 1/1979 | Schuler | 72/388 |

FOREIGN PATENT DOCUMENTS

| | | | |
|---|---|---|---|
| 1201662 | 9/1965 | Fed. Rep. of Germany | 72/459 |
| 1384575 | 2/1975 | United Kingdom . | |
| 1463522 | 2/1977 | United Kingdom | 72/217 |
| 615989 | 7/1978 | U.S.S.R. | 72/387 |

*Primary Examiner*—Gene Crosby
*Attorney, Agent, or Firm*—Felfe & Lynch

[57] ABSTRACT

A bending device for metal pipe with and without plastic jacketing has a short cylindrical segment including a circumferential groove which determines the bending radius of the pipe to be bent and a support for holding the pipe to be bent tangentially with respect to the groove. A lever is mounted for concentric pivotable movement about the segment and a pressing block is mounted on the lever for pivotal movement about an axis parallel to the segment axis. The pressing block has a working surface which has an approximately semicircular, concave cross section in a plane disposed parallel to the pivot axis of the pressing block and the segment axis and a concave cross section in a plane disposed perpendicular to those axes.

15 Claims, 7 Drawing Figures

Figures 1, 1A:
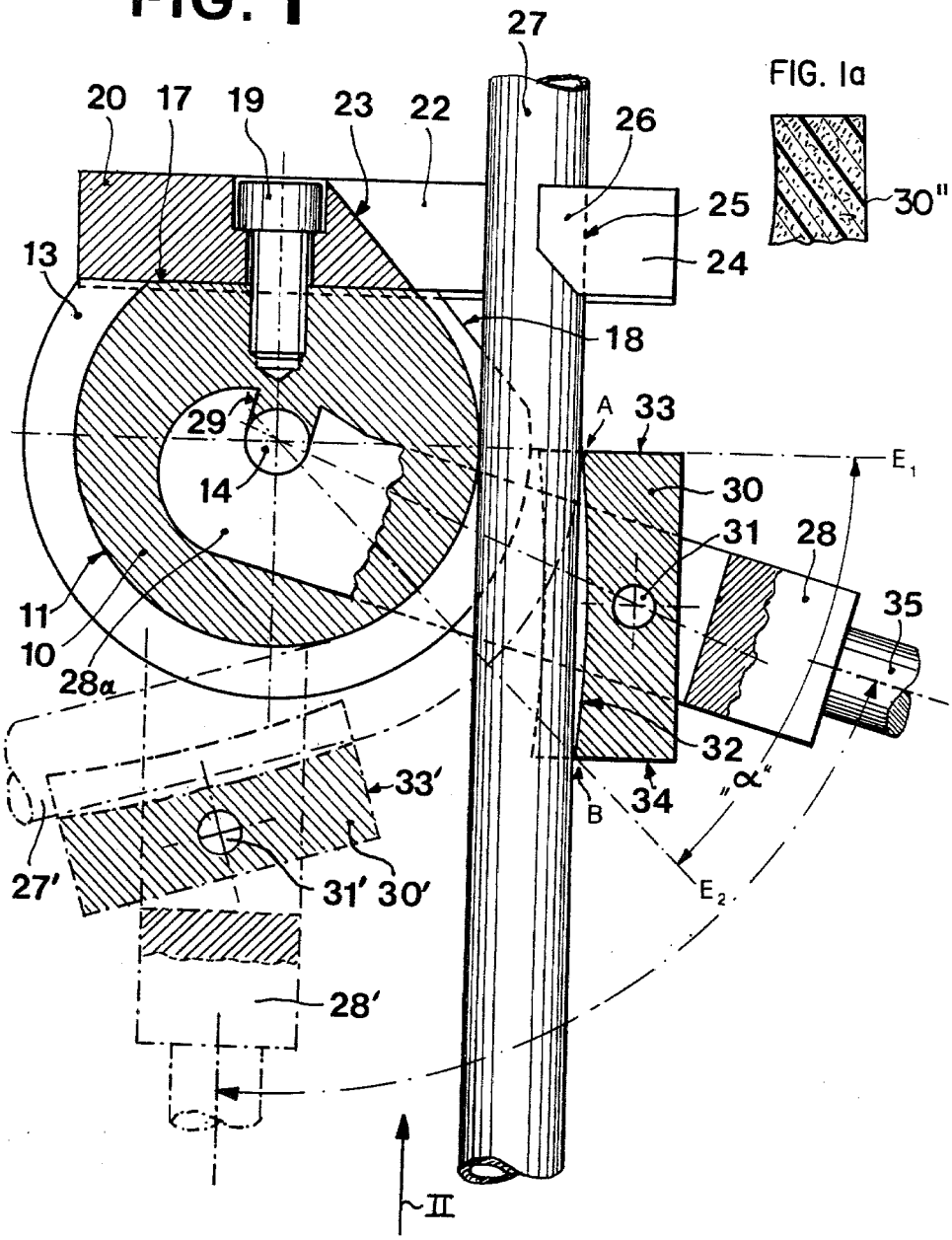

FIG. 2
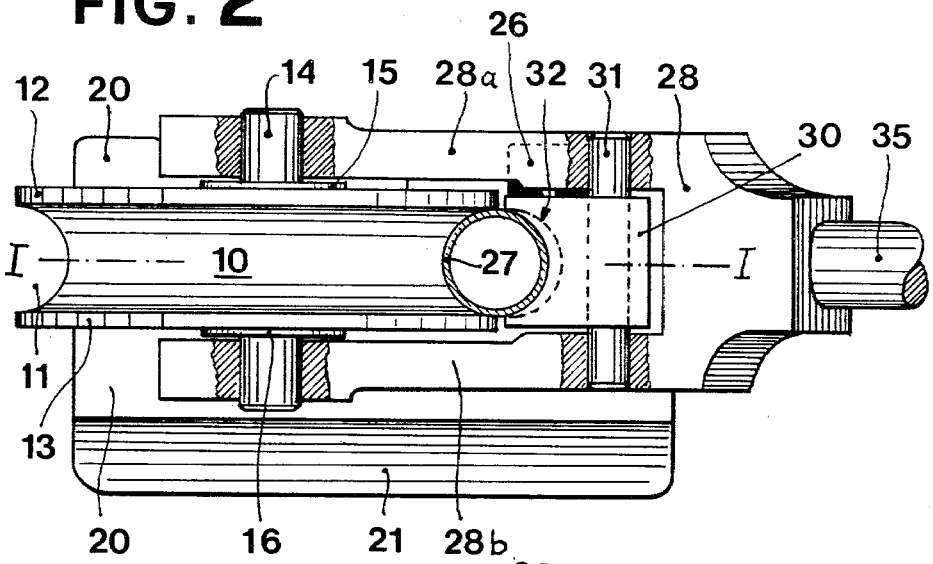
FIG.3
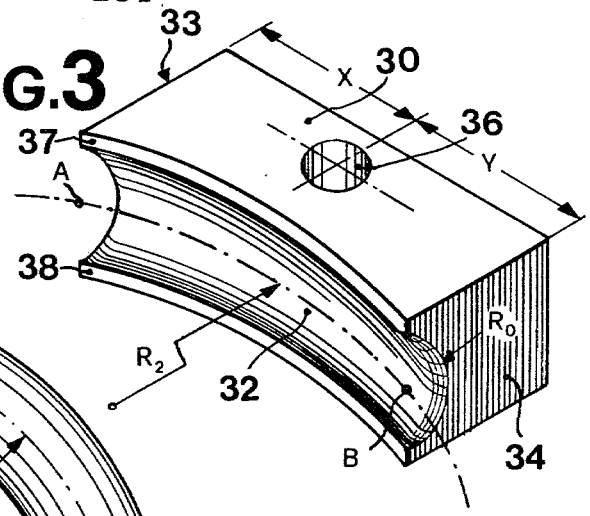
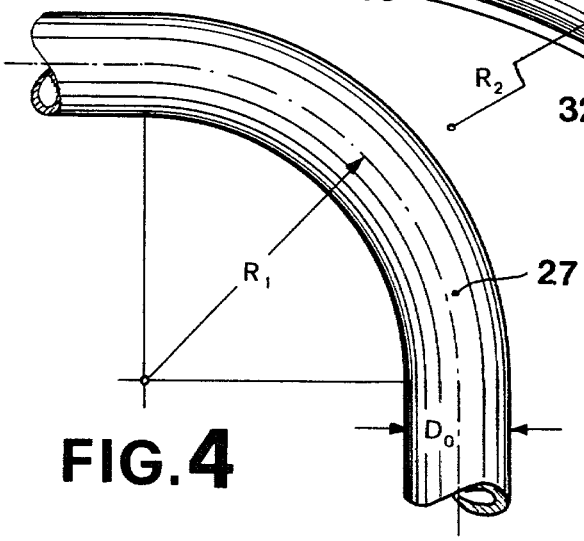
FIG.4

FIG. 6
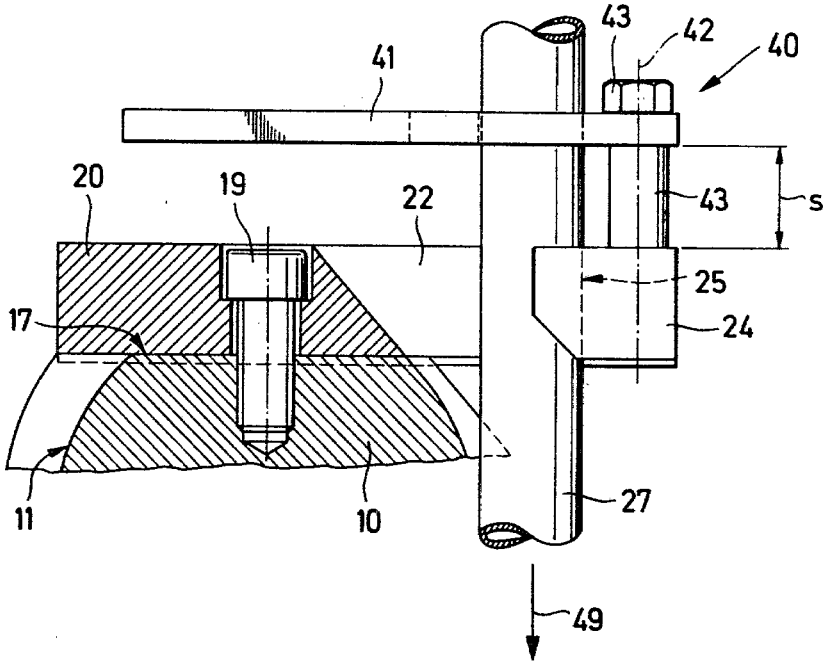
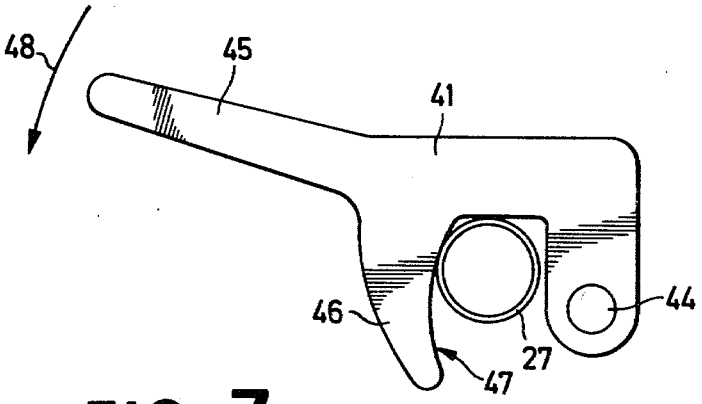
FIG. 7

DEVICE FOR BENDING METAL PIPE

The invention relates to a metal pipe bender having a cylinder segment on whose circumference there is provided a groove which determines the bending radius. With the cylinder segment there is associated a pipe rest for holding the tube tangential to the groove, and a lever which can pivot about the axis of the cylinder segment and on which a pressing block, which can also be called a slip shoe, is mounted on a pin parallel to the axis of the cylinder segment. This pressing block has a working surface which, in a plane parallel to the segment and pressing block axes, has an approximately semicircular, concave cross section with the radius $R_0$. While this working surface was formed in the previously known bending devices by a cylinder surface, the pressing block, in accordance with the invention, is to be made additionally concave in a plane perpendicular to the segment and pressing block axes. In one especially preferred embodiment of the working surface, the latter is in the form of the surface of a torus whose long radius $R_2$ is between 2 to 10 times the bending radius $R_1$ of the pipe. The device of the invention can be formed not only by a toric working surface but also by an analogous arrangement of rollers.

The invention relates to a device for bending plastic-jacketed or plain metal pipe and tubing, especially in plumbing work, consisting of a segment of a short cylinder on whose circumference there is disposed a groove determining the bending radius $R_1$ of the pipe, and with which there is associated a rest for holding the pipe tangential to the groove, and of a lever which can be swung concentrically about the segment, on which lever there is disposed, on a pivot parallel with the segment pivot, a pressing block having a working surface which has, in a plane parallel to the axes, an approximately semicircular, concave cross-section having the radius $R_0$.

U.S. Pat. No. 2,820,504 discloses a pipe bender having a toroidal pressing block which forms a rigid unit with an operating lever. The pressing block cannot pivot about a concentric axis of the cylinder segment in a single motion while performing a sliding movement on the tube in the bending process. Instead, the pressing block is guided on rails on the margin of the cylinder segment, so that, by repeated levering of the pressing block about imaginary pivot axes located on the rails, the tube is forced section by section into the groove in the cylinder segment. The pressing block is therefore a kind of molding press whose inner shape corresponds to the external shape of the bent tube. Absolutely smooth bends cannot be achieved with this known device, and instead imprints of the pressing block can be seen at regular intervals on the tube surface.

G.B. Pat. No. 1,384,575 discloses a bending device for the production of additional bends in already bent tubing, whose principle of action is a kind of cinematic reversal of the principle of action of the bending device first described. In this case the pressing block is stationary and the cylinder segment with the circumferential groove is able to swing, under hydraulic drive, with respect to the pressing block. The pressing block, however, is made in the manner of a roof gutter, i.e., it is rectilinear in the direction of the tubing. Therefore no effects can be achieved other than those obtainable with the invention first described.

U.S. Pat. No. 3,410,125 also makes known a bending device having a cylinder segment and a circumferential groove, which can pivot in relation to a bipartite pressing block about the axis of the cylinder segment, while the pressing block draws the tubing into the circumferential groove. Also, the pressing block is again rectilinear in the longitudinal direction of the tubing, since the initially stretched tube is drawn out of it. With this device, too, no effects can be produced other than those obtainable with the invention first described.

In the above-described bending devices, the pressing block also is essentially parallelipipedal in shape, and has on its side facing the tube or segment a working surface of a semicylindrical shape complementary to the shape of the pipe that is to be bent. Such a surface is concave, but only in respect to a cross section situated in a plane parallel to the axes of the segment and pressing block or passes therethrough. The generatrices are rectilinear.

With a bending device of this kind, soft copper pipe can easily bent to a ratio of bending radius $R_1$ to pipe diameter $D_o$ of approximately 3:1. This is true, in any case, of piping made of annealed copper with outside diameters of, for example, 15, 18 or 22 mm, with a wall thickness of 1.0 to 1.5 mm. In plumbing practice it is desirable to obtain the smallest possible bending radius, and the bends are to be made without buckling, and in any case without cracking. Another criterion is a minimum of flattening, i.e., a minimum of departure from the original circular cross section of the pipe. Generally, a flattening of approximately 10% of the original pipe diameter is considered to be tolerable.

Even in the bending of annealed copper tubing by means of the known bending device it is necessary to apply a great effort whose magnitude would of course depend on the length of a hand lever and/or on a gear train. This application of force, however, left traces on the bent pipe, for example with regard to the above-mentioned flattening and with regard to visible depressions at the point where the pipe engages the pipe rest. The need for great effort can be explained approximately as follows: when the bending device is in the starting position and the pipe is straight, the axis of the pressing block, which is also called the slip shoe, is situated in a plane which is substantially perpendicular to the tube axis and the segment axis. If now the pressing block or slip shoe is moved about the segment axis against the pipe, the pressing block assumes an attitude to the pipe surface nearest the pressing block axis such that the generatrices of the working surface are tangential to the tube surface. On account of the unavoidable friction, which can be reduced by lubricants but not eliminated entirely, the pressing block has a tendency to pivot on its axis, thereby increasing the pressing pressure on account of the given geometrical circumstances, even though the distance between the segment axis and the pressing block axis remains unchanged. On account of the great amount of leverage, this process results in friction approaching the seizing point, whereby great tensile stress is imposed on the outer fibers of the pipe. It can be assumed that these tensile stresses as well as the intensified contact pressure of the pressing block are the cause of the relatively great flattening of the pipe cross section in the case of annealed copper. This flattening is virtually unavoidable, although both the circumferential groove in the segment and the contact surface in the pressing block are of a configuration complementary to that of the pipe.

Also in the state of the art is a bending device of the kind described in the beginning, in which the pressure block is in the form of a wheel in the shape of a negative torus, i.e., the concave tread surface of the wheel is in the shape of a semicircle. It has surprisingly been found that neither in this manner are the conditions substantially improved, apparently because the tube, under the effect of the great deformation forces, engages the wheel surface at different diameters, thereby again resulting in a perceptible drag.

As soon as annealed copper pipe is replaced with pipes of hard copper, brass or steel, the bending devices using the known pressing blocks prove to be entirely unserviceable for the required small bending radii. Plumbers like to use hard copper wire, i.e., pipe as it comes directly from the manufacturer's drawing machines, because it is stronger and less expensive. As soon as a pipe of hard copper is inserted into any of the benders that can easily be used with soft copper pipe, an extremely great effort is required to bend it, resulting, even after a slight bend of, say, 10 to 15 degrees, in a plainly visible yielding of the copper and then in an abrupt rupture of the pipe on the outer side. The behavior of brass and steel pipes is similar. $R_1$:$D_o$ ratios of 3:1, and even of only 5:1, cannot be achieved in this manner. Plastic jacketed pipe cannot be worked with the above-described benders even at large bending radii, because the slip shoe tears off the plastic skin, so that the bent pipe has to be discarded.

It is the object of the invention to provide a bending device of the kind described in the beginning, with which not only annealed copper pipe but also hard copper as well as brass and steel pipe can be bent to a very small $R_1$:$D_o$ ratio, reliably, with a minimum flattening, and with a small amount of effort.

This object is accomplished in accordance with the invention, in the initially described bending device, by making the pressing block additionally concave in a plane I—I perpendicular to the axes. This teaching means, with respect to an unbent pipe, that the pressing block engages the tube on only two substantially semicircular lines, or that the center of the pressing block directly adjacent the pressing block pivot axis is set back from the tube surface.

It has been found surprisingly that, instead of the worsening of the conditions which would be anticipated on the basis of the Hertzian equations, the measure taken in accordance with the invention brings about a substantial improvement: for example, pipes of hard copper, brass and steel with an outside diameter of 18 mm have been provided with a bend radius between 45 and 65 mm without difficulty, and in the case of hard copper versus annealed copper, a saving of effort of approximately 30% (under otherwise identical leverage conditions) has been observed. The surface of the pipe was flawless and free of buckling. No indentation was to be observed at the location of the pipe rest. The flattening was between 0.8 and 1.2 mm, i.e., between about 4.5 and 6.7%. This is decidedly less than the limit specified in pertinent work guidelines, of 10% of the pipe diameter.

An especially easy to manufacture and effective embodiment of the bending device of the invention is obtained when the contact surface of the pressing block is toric or toroidal, the large radius $R_2$ being between twice to ten times the bending radius $R_1$ of the pipe. An optimum reduction of the bending effort is achieved when the large radius of the torus is between four and six times the bending radius $R_1$ of the pipe, and a certain optimation of the conditions can be observed at an $R_2$:$R_1$ ratio of 5:1.

In a very especially desirable manner, the torus surface, with respect to the circumference of the segment, extends over an angle "$\alpha$" between 40 and 50 degrees, it being desirable to set the pivot axis of the pressing block slightly off-center longitudinally, so that the ends of the pressing block which cooperate with the pipe will have lever arms of different length, the lengths being designated by "X" and "Y". Depending on the deformation properties of the pipe, the length "Y" of the lever arm that is farthest from the segment when in the working position, can be made approximately 20 to 40% shorter or longer than the length "X" of the other lever arm. If "Y" is shorter than "X", the contact pressure of the pressing block edge nearest the segment is slightly lower than at the opposite end of the pressing block, so that the pressing block slips still more easily on the pipe. It has, of course, proven to be desirable to thoroughly round the ends of the pressing block or torus surface that are in contact with the pipe, and it has been found that an edge radius of 0.5 mm is sufficient. The rounding promotes the sliding action by providing a wedging action for the lubricant that is used as a rule.

With regard to the bending of metal pipes jacketed in plastic, especially steel pipes, it has proven to be especially desirable to make the pressing block of a mechanically very strong plastic such as polyamide, for example. To increase the mechanical strength of this material it is especially desirable to provide it with glass fiber reinforcements or metal inserts aligned preferably lengthwise of the pressing block. It is quite especially desirable to use in this case a plastic which either has good antifriction properties by nature or is provided with lubricants.

Additional developments of the invention and the advantages thereof will be seen in the subordinate claims, particularly the proportioning of the length of the pressing block and its geometrical disposition on the lever, which will be more easily understood in conjunction with the drawings.

Figure 5:
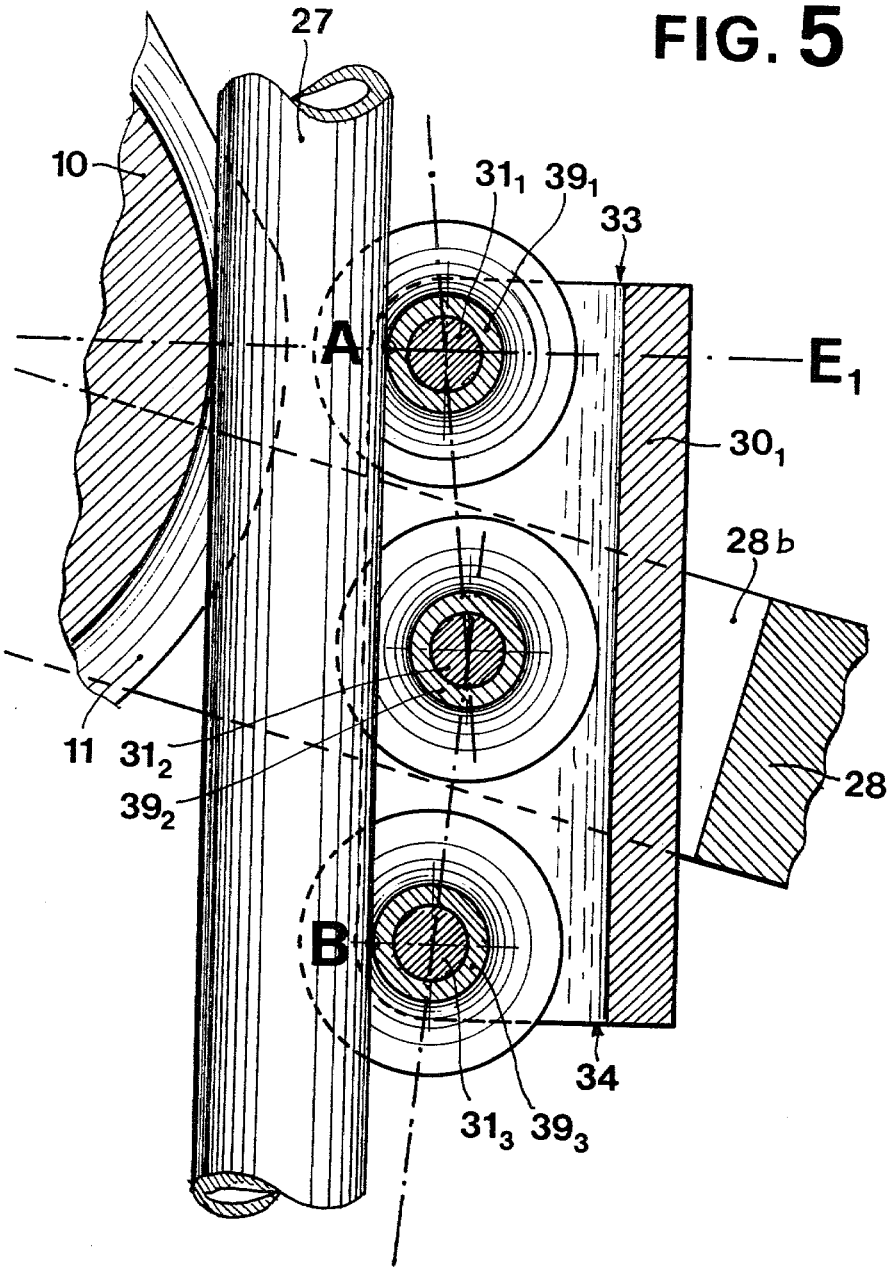

An example of the embodiments of the invention will be described hereinafter with reference to FIGS. 1 to 7, wherein:

FIG. 1 is a horizontal cross-sectional view through a complete bending device with the pipe inserted, in the starting position (solid lines) and in an intermediate position (broken lines), in the making of a pipe bend of 90 degrees along the plane of symmetry I—I in FIG. 2, FIG. 1*a* is a sectional view of a portion of an alternative embodiment of the pressing block of FIG. 1;

FIG. 2 is a view of the object of FIG. 1 as seen in the direction of the arrow II, the forked lever which straddles the segment and the pressing block being partially cut away at the pivot shaft bearings, FIG. 3 is a perspective view of the pressing block on an enlarged scale, FIG. 4 is a top plan view of a finished pipe bend, to explain the critical dimensions which are important in judging it, FIG. 5 is a detail of a cross section similar to FIG. 1, taken through a variant in which the pressing block is equipped with rollers, FIG. 6 is a detail of FIG. 1 showing an accessory for larger pipe diameters, and FIG. 7 is a side view of the accessory of FIG. 6.

In FIGS. 1 and 2 there is represented a segment 10 in the form of a short cylinder, which is provided with a circumferential groove 11 which has a semicircular cross section complementary to the pipe to be bent. To bend the pipe, the latter is inserted into the groove 11 so that the groove determines the bending radius. On either side of the groove 11 two flanges 12 and 13 are formed whose outside diameter is the same as the bending radius $R_1$. A fulcrum pin 14 is disposed concentrically to the groove 11 in segment 10, and is surrounded by two hub portions 15 and 16 which protrude slightly above the surfaces of both sides of the segment 10.

The segment 10 is developed from the fact that on one side a small portion has been removed, forming a flat 17. At a point 18 on the circumference, a portion of the flanges 12 and 13 have also been removed along a planar surface, but in such a manner that the bottom of the groove 11 has been left unaffected. A base plate 20 is fastened by means of a bolt 19 to the flat 17, and extends considerably beyond the segment 10 and the shaft 14 at its bottom, where it has a portion of reduced thickness for mounting the pipe bender in a vise. The base plate 20 contains a cut-out 22 which has a depth equal to the entire height of the segment 10 and is defined on one side by a slanting surface 23 merging approximately tangentially with the bottom of the groove. On its opposite side, the cut-out 22 is provided with a pipe rest 24 in the form of a semicircular hook 25 having a tip 26. The position and shape of the pipe rest 24 are designed such that a pipe 27, as shown in FIG. 1, can be inserted into the hook 25 and into the groove 11 so as to be tangential to the bottom of the groove and perpendicular to the flat 17. The contact point of the tangent lies in a plane $E_1$ extending through the shaft 14 parallel to the flat 17.

A forked lever 28 can be hooked radially onto the fulcrum pin 14 by means of notches 29 adapted to the shaft 14. The lever 28 has two limbs 28*a* and 28*b* astride the segment 10 and the pipe 27. Between the limbs 28*a* and 28*b* there is also disposed a pressing block 30 which can pivot on a pin 31 parallel with fulcrum pin 14, and has a working surface 32 which is of semicircular shape in cross section, i.e., in a plane parallel to the pins 14 and 31. As seen in FIG. 1, the pressing block or its working surface is additionally of concave configuration in a plane perpendicular to the pins 14 and 31, this plane being defined as I—I in FIG. 2, and indeed the working surface 32 is a toric surface whose large radius $R_2$ is five times the bending radius $R_1$. The small radius $R_0$ of the toric surface corresponds to the radius of the pipe 27. The center point of the large radius $R_2$ is at a considerable distance beyond the left edge of FIG. 2. A torus is a tubular annular mathematical body which is formed by the rotation of a circle about an axis which is situated in its plane and does not intersect the body. It can be understood that slight departures from the mathematically precise definition are permissible.

As it can be seen in FIGS. 1 and 2, but especially in FIG. 3, the working surface 32 is disposed on one side of the parallelipipedal pressing block 30, the ends of the toric surface being well rounded at the points of transition A and B into the ends 33 and 34. The intersections between the toric surface and the ends 33 and 34 are (disregarding the rounding) semicircles which correspond to the cross section of the pressing block 30 along the axis 31.

The length and disposition of the pressing block 30 on the lever 28 are, in accordance with FIG. 1, such that in the starting position the one transition point A lies substantially in the plane $E_1$ which is perpendicular to the pipe 27 and radial to the segment shaft 14. The other transition point B lies in a plane $E_1$ which likewise is radial to the segment axis 14, but includes an angle of 45 degrees with the plane $E_1$. In this starting position, the pressing block 30, which can also be referred to as a slip shoe, lies at the (semicircular) transition points A and B on the pipe 27, if only a slight force is exercised in the clockwise direction on the lever 28. To enable the lever 28 to be operated by hand, it is provided with a handle 35 whereby the lever is prolonged approximately four- to five-fold (not shown).

As soon as a greater force is exerted clockwise on the lever 28, the pressing block 30 begins to slide along the pipe 27 and to bend the latter into the groove 11. After the lever 28 has been turned by an angle of about 70 degrees, the position represented in broken lines in FIG. 1 is reached, in reference to which the reference numbers are provided with a prime mark (′). It can be seen that here the end face 33′ has maintained a substantially radial attitude towards the segment axis 14. A portion of the pipe bend produced when the lever 28 has been turned an additional 20 degrees is represented in FIG. 4, in which the dimensions $R_1$ and $D_o$ are also indicated.

It can be seen in FIG. 3 that a bore 36 is provided within the pressing block 30 for the pivot pin 31 which is disposed excentrically between the two end faces 33 and 34, at the distances or lever arms X and Y. In a preferred embodiment, the ratio of X:Y amounted to 44:35. It should be added, with reference to FIG. 3, that the appearance of the toroidal working surface 32, which is defined on both sides by the flange sectors 37 and 38, is represented in an exaggerated manner for the sake of clarity.

The pressing block 30 is shown in FIG. 1 as comprising metal, however, the block 30″ can also preferably comprise plastic or fiber-reinforced plastic as shown in FIG. 1*a*.

In FIG. 5 there is represented a bending device of substantially similar action, in which the working surface of the pressing block $30_1$ is composed of portions, namely of three rollers $39_1$, $39_2$ and $39_3$ having circumferential grooves of semicircular cross section. In the representation given in FIG. 5, which is largely the same as that in FIG. 1, only the two outside rollers $39_1$ and $39_2$ are in linear contact with the (straight) pipe (27).

The points where the semicircular lines of contact pass through the plane of the drawing are indicated by two small circles; these are analogous to the points of transition A and B in FIG. 1. The rollers are mounted on axles $31_1$, $31_2$ and $31_3$, which are parallel to the fulcrum axis of the segment 10. The middle axle $31_2$ is simultaneously the one by which the pressing block $30_1$ is pivoted in the lever 28, this, too, being substantially the same as the device represented in FIG. 1. In the present case, the pressing block $30_1$ consists of a channel-shaped block in the sides of which the said axles $31_1$, $31_2$ and $31_3$ are mounted.

If three rollers are used, as represented in FIG. 5, the middle roller $39_2$ is offset outwardly from the segment axle 14 and from the two outer rollers $39_1$ and $39_3$. This offset is such that a circle tangent to the rollers in the illustrated cross-sectional plane has a radius that is from twice to ten times the bending radius $R_1$ of the pipe 27, preferably between four and six times the bending radius $R_1$ of the pipe.

In FIG. 6 there is represented a detail from FIG. 1. In it can be seen the upper portion of the segment 10 with the groove 11 and the flat 17 to which the base plate 20 is fastened by the bolt 19. This base plate contains the cut-out 22 and the pipe rest 24 which is provided with the semicircular hook 25. The pipe 27 is inserted into the hook 25; to this extent the embodiment is the same as in FIG. 1. Furthermore, a gripping means 40 is disposed on the side of the base plate 20 and support 24 that is opposite the segment 10. This gripping means consists of a dog 41 whose appearance is represented in FIG. 7. The dog 41 is made from a plate and can be swung in a plane that is parallel to the base plate 20 bearing the support 24. The clearance between the base plate 20 and the dog 41 amounts to the dimension "s". The dimension "s" can in practice be between one half and several times the pipe diameters. The dog 41 can pivot about the axis 42 formed by a bolt 43 screwed into the base plate 20. The distance between the base plate and the dog 41 is maintained by means of a spacer 43, the bolting being so arranged that the dog 41 is freely rotatable on the bolt 43. The axis 42 is parallel to the long axis of the pipe 27.

In accordance with FIG. 7, the dog 41 has a bore 44 for the accommodation of the bolt 43, a hand lever 45, and a hook 46 whose inside surface 47 is substantially concentric with the center axis of bore 44 and therefore with the pivot axis. A slight excentricity provides such that, when the hand lever 45 is pulled down in the direction of the arrow 48, an additional transverse force is exercised on the pipe 27. By this transverse force, the pipe 27 is forced away from the segment 10 into the hook 25 in the pipe rest 24.

By this additional tightening of pipe 27 against the pipe rest 24, in the direction of the force of the reaction to the bending force, the following is achieved: As an effect of the bending force, the pipe 27 tends to flex resiliently to a slight extent outside of the actual bend zone, so that the portion of pipe 27 situated beyond the segment 10 in FIG. 6 moves slightly leftward. This is evidently the reason why the pipe 27 slips slightly in the direction of the arrow 49 during the bending action. In any case, without the accessory represented in FIGS. 6 and 7, slight ripples occasionally appear on the side of the pipe bend facing the segment 10, especially in the case of the larger pipe diameters, i.e., those greater than 20 mm, and they adversely affect the appearance of the pipe bend. By means of the dog 41, both the resilient transverse deflection of the tube and the slippage are prevented virtually completely, so that in any case the rippling of the pipe is prevented. The dog 41 produces, on the basis of the spacer 43 or the distance "s" as the case may be, a bending moment on pipe 27 opposed to the resilient deflection, and this holds the pipe 27 in the proper position in the groove 11. In this manner, any lateral movement of the pipe 27 out of the groove 11 is substantially prevented, so that the flattening of the pipe to an oval cross section, which would otherwise occur in the bending and would not be prevented by the flanges 12 and 13 (FIG. 2), is largely prevented. The accessory device represented in FIGS. 6 and 7, by its cooperation with the other parts of the pipe bender, results, in any case, in an additional improvement of the quality of the pipe bend.

I claim:

1. A bending device for metal pipe with and without plastic jacketing comprising: a short cylindrical segment including a circumferential groove which determines the bending radius of the pipe to be bent; support means for holding the pipe to be bent tangentially with respect to the groove; a lever; means mounting the lever for continuous concentric pivotable movement about the axis of the segment; a pressing block; means mounting the pressing block on the lever for pivotal movement about an axis parallel to the segment axis; and wherein the pressing block includes means forming a working surface which has an approximately semicircular, concave cross section in a plane disposed parallel to the pivot axis of the pressing block and the segment axis and a concave cross section in a plane disposed perpendicular to those axes.

2. The bending device of claim 1, wherein the working surface of the pressing block is a portion of a hollow torus surface whose larger radius is between two to ten times the bending radius.

3. The bending device of claim 2, wherein the larger radius of the torus is between four to six times the bending radius.

4. The bending device of claim 2 or claim 3, wherein the pressing block is parallelipipedal and the working surface is disposed on a long side of the pressing block and the ends of the torus surface are rounded at the transition points into the end faces of the pressing block.

5. The bending device of claim 4, wherein the transition point rounding radius is at least 0.5 mm.

6. The bending device of claim 4, wherein the means mounting the pressing block on the lever mounts same for movement from a starting position wherein one transition point lies substantially in a first plane which is perpendicular to the held pipe and radial to the segment axis and the other transition point lies in a second plane which is radial to the segment axis, the first and second planes including an angle between 30 and 60 degrees and and wherein the pressing block engages the held pipe with both transition points.

7. The bending device according to claim 6, wherein the first and second planes include an angle of between 40 and 50 degrees.

8. The bending device of claim 6, wherein the pivot axis of the pressing block is disposed in the pressing block at a lengthwise distance X and Y from the ends thereof and wherein the ratio X:Y is between 1.4 and 0.7.

9. The bending device of claim 1, wherein the pressing block comprises steel.

10. The bending device of claim 1, wherein the pressing block comprises plastic.

11. The bending device of claim 10, wherein the pressing block comprises glass fiber-reinforced plastic.

12. The bending device of claim 9 or claim 10, wherein the pressing block is used with a lubricant.

13. The bending device of claim 1, further comprising means for gripping the held pipe away from the segment and against the support means, the gripping means disposed on the side of the support means opposite the segment at a distance from the support means lengthwise of the held pipe.

14. The bending device of claim 13, wherein the support means comprises a base plate and a pipe rest borne thereon and wherein the gripping means comprises a dog disposed in a plane parallel to the base plate and pivotable about an axis disposed parallel to the held pipe.

15. The bending device of claim 10 wherein the pressing block has anti-friction properties.

* * * * *